US007825608B2

(12) United States Patent
Kimura

(10) Patent No.: US 7,825,608 B2
(45) Date of Patent: Nov. 2, 2010

(54) MULTI-DISCHARGE TUBE LIGHTING APPARATUS

(75) Inventor: Kengo Kimura, Saitama-ken (JP)

(73) Assignee: Sanken Electric Co., Ltd., Saitama (JP)

( * ) Notice: Subject to any disclaimer, the term of this patent is extended or adjusted under 35 U.S.C. 154(b) by 265 days.

(21) Appl. No.: 12/022,901

(22) Filed: Jan. 30, 2008

(65) Prior Publication Data

US 2008/0211424 A1 Sep. 4, 2008

(30) Foreign Application Priority Data

Mar. 2, 2007 (JP) ..... 2007-053313

(51) Int. Cl.
*H05B 41/16* (2006.01)

(52) U.S. Cl. ..... 315/277; 315/282; 315/312

(58) Field of Classification Search ..... 315/274–289, 315/291, 294, 307, 312
See application file for complete search history.

(56) References Cited

U.S. PATENT DOCUMENTS

| | | | | |
|---|---|---|---|---|
| 7,633,240 | B2 * | 12/2009 | Kwon | 315/282 |
| 2005/0099143 | A1 * | 5/2005 | Kohno | 315/312 |
| 2006/0244395 | A1 * | 11/2006 | Taipale et al. | 315/277 |
| 2007/0108918 | A1 * | 5/2007 | Sengoku et al. | 315/282 |
| 2008/0067944 | A1 * | 3/2008 | Wang et al. | 315/185 R |
| 2008/0088403 | A1 * | 4/2008 | Suzuki et al. | 336/198 |

FOREIGN PATENT DOCUMENTS

| | | |
|---|---|---|
| JP | 09-161980 | 6/1997 |
| JP | 2004-335443 A | 11/2004 |
| JP | 2006-012660 | 1/2006 |

OTHER PUBLICATIONS

Office Action issued in Korean Patent Application No. 10-20052008-0009310, dated Mar. 4, 2009 (4 pages).
English Translation of an Office Action issued in Korean Patent Application No. 10-20052008-0009310, dated Mar. 4, 2009 (5 pages).

* cited by examiner

*Primary Examiner*—Douglas W Owens
*Assistant Examiner*—Tung X Le
(74) *Attorney, Agent, or Firm*—Wilmer Cutler Pickering; Hale and Dorr LLP

(57) ABSTRACT

A multi-discharge tube lighting apparatus connectable to a power source comprising a first output terminal and a second output terminal respectively outputting voltages of opposite phases, the lighting apparatus comprises first to n-th discharge tube units where n represents an integer of two or more, each of which has a first end connected to the first output terminal and a second end connected to the second output terminal and comprises at least one discharge tube, a first winding, and a second winding, which are connected in series between a first end and a second end. The first winding of the first discharge tube unit is electromagnetically coupled via a transformer to the second winding of the n-th discharge tube unit. The first windings of the second and subsequent discharge tube units are electromagnetically coupled via transformers to the second windings of the previous discharge tube units, respectively.

16 Claims, 8 Drawing Sheets

MULTI-DISCHARGE TUBE LIGHTING APPARATUS

CROSS-REFERENCE TO RELATED APPLICATIONS

This application is based upon and claims the benefit of priority from Japanese Patent Application No. 2007-053313, filed on Mar. 2, 2007, the entire contents of which are incorporated herein by reference.

TECHNICAL FIELD

The present invention is related to a multi-discharge tube lighting apparatus capable of driving a plurality of discharge tube units with a reduced number of current balancing transformers.

BACKGROUND

In a liquid crystal display apparatus such as a liquid crystal display television using a plurality of discharge tubes in a single panel of a liquid crystal screen, it is necessary to illuminate the entire liquid crystal screens in uniform luminance from the discharge tubes. If the plurality of discharge tubes are lighted (turned ON) in different current values, an illumination failure such as unequal luminance gradations may occur. FIG. 10 shows a multi-discharge tube lighting apparatus for applying AC high voltages (alternating high voltages) to one terminal of each of a plurality of discharge tubes so as to balance currents flowing through the respective discharge tube. As shown in FIG. 10, the multi-discharge tube lighting apparatus includes: 3 sets of discharge tube units 1 to 3; an AC power supply 10; transformers T1 to T3; another transformer T4; and still another transformer T5. Each of the three discharge tube units 1 to 3 includes: a first discharge tube 1*a* and a first winding 1*b*, which are series-connected to each other; and a second discharge tube 2*a* and a second winding 2*b*, which are series-connected to each other. One terminal of each of the first discharge tubes 1*a* and each of the second discharge tubes 2*a* is connected to the AC power supply 10 via a capacitor 20. In each of the transformers T1 to T3, the first winding 1*b* is electromagnetically coupled to the second winding 2*b*. In the transformer T4, a first winding 1*b* is electromagnetically coupled to a second winding 2*b*, where the first winding 1*b* is connected to both the first winding 1*b* and the second winding 2*b* of the transformer T1, and the second winding 2*b* is connected to the first winding 1*b* and the second winding 2*b* of the transformer T2. In the transformer T5, a first winding 1*b* is electromagnetically coupled to a second winding 2*b*, where the first winding 1*b* is connected between the first and second windings 1*b*, 2*b* of the transformer T4 and the ground, and the second winding 2*b* is connected between the first and second windings 1*b*, 2*b* of the transformer T3 and the ground. The current flowing through the discharge tube 1*a* and the current flowing through the discharge tube 2*a* of the first discharge tube unit 1 which is connected between the AC power supply 10 and the ground via the capacitors 20 and the transformer T1 is balanced by the first winding 1*b* and the second winding 2*b* of the transformer T1, so that the same current flows through the discharge tubes 1*a* and 2*a*. The total current of the two discharge tubes, i.e., the first discharge tube 1*a* and the second discharge tube 2*a*, flows through a junction point between the first winding 1*b* and the second winding 2*b* of the transformer T1.

Similarly, the current flowing through the discharge tube 1*a* and the discharge tube 2*a* of the second discharge tube unit 2 connected between the AC power supply 10 and the ground via the capacitors 20 and the transformer T2 is balanced by the first winding 1*b* and the second winding 2*b* of the transformer T2, so that the same current flows through the first discharge tube 1*a* and the second discharge tube 2*a*. The total current of two discharge tubes, i.e., the first discharge tube 1*a* and the second discharge tube 2*a*, flows through a junction point between the first winding 1*b* and the second winding 2*b* of the transformer T2.

Similarly, the current flowing through the discharge tube 1*a* and the discharge tube 2*a* of the third discharge tube unit 3 connected between the AC power supply 10 and the ground via the capacitors 20 and the transformer T3 is balanced by the first winding 1*b* and the second winding 2*b* of the transformer T3, so that the same current flows through the first discharge tube 1*a* and the second discharge tube 2*a*. The total current of two discharge tubes, i.e., the first discharge tube 1*a* and the second discharge tube 2*a*, flows through a junction point between the first winding 1*b* and the second winding 2*b* of the transformer T3.

The junction point between the first winding 1*b* and the second winding 2*b* of the transformer T1 is connected to the first winding 1*b* of the transformer T4, and the junction point between the first winding 1*b* and the second winding 2*b* of the transformer T2 is connected to the second winding 2*b* of the transformer T4. Therefore, the current flowing through the first discharge tube unit 1 and the second discharge tube unit 2 is balanced by the transformer T4, so that the same current flows through the first discharge tube unit 1 and the second discharge tube 2. The total current of the four discharge tubes, i.e., the discharge tubes of the first discharge tube unit 1 and the second discharge tube unit 2, flows through the junction between the first winding 1*b* and the second winding 2*b* of the transformer T4. The current of two discharge tubes, i.e., the third discharge tube unit 3, flows through the junction between the first winding 1*b* and the second winding 2*b* of the transformer T3.

The junction point between the first winding 1*b* and the second winding 2*b* of the transformer T4 is connected to the first winding 1*b* of the transformer T5, and the junction point between the first winding 1*b* and the second winding 2*b* of the transformer T3 is connected to the second winding 2*b* of the transformer T5. As a consequence, the current flowing through 4 pieces of the discharge tubes flows through the first winding 1*b* of the transformer T5, whereas the current flowing through 2 pieces of the discharge tubes flows through the second winding 2*b* of the transformer T5, so that a turn ratio of the first winding 1*b* to the second winding 2*b* is set to such a value obtained by multiplying the flowing current by an inverse number. For instance, the current for the 4 discharge tubes flows through the first winding 1*b* of the transformer T5, whereas the current for the 2 discharge tubes flows through the second winding 2*b* thereof. As a result, a ratio of the current becomes a relationship of 2:1. As a consequence, assuming now that a turn number of the first winding 1*b* of the transformer T5 is equal to 1, a turn ratio of the first winding 1*b* to the second winding 2*b* of the transformer T5 is set to be 1:2, namely, a turn number of this second winding 2*b* is set to 2. Any of these transformers T1 to T5 have an effect capable of averaging and balancing the current flowing through the respective discharge tubes 1*a* and 2*a*.

A multi-discharge tube lighting apparatus shown in FIG. 11 has a configuration that the capacitors 20 are omitted from the above-described multi-discharge tube lighting apparatus shown in FIG. 10. Another multi-discharge tube lighting apparatus shown in FIG. 12 has a configuration that the transformers T1 to T5 are omitted from the above-explained multi-discharging tube lighting apparatus, the first discharge tube 1*a* and the second discharge tube 2*a* of each of the first to third discharge tube units 1 to 3 are directly connected to each other to have a U-shape. Although the first discharge tube 1*a* and the second discharge tube 2*a* of each of the discharge tube units 1 to 3 are connected to one terminal and the other terminal of an AC power supply 10 which generates AC voltages having opposite phases to each other, this multi-discharge tube lighting apparatus of FIG. 12 cannot average and balance the current flowing through the respective discharge tube units 1 to 3. FIG. 13 shows another multi-discharge tube lighting apparatus. In the multi-discharge tube lighting, series-connected first and second windings 1*b*, 2*b* connected to each of the discharge tubes 1*a* and 2*a* are connected to a common line 4. The first winding 1*b* of the first discharge tube 1*a* of the first discharge tube unit 1 is electromagnetically coupled to the second winding 2*b* of the second discharge tube 2*a* of the third discharge tube unit 3 connected via the common line 4 to the first winding 1*b* of the second discharge tube 2*a* of the third discharge tube unit 3. Each of the first windings 1*b* of the second and subsequent discharge tube 2*a* of the first discharge tube unit 1 is electromagnetically coupled to the second winding 2*b* which is connected to the pre-staged discharge tube. That is, conversely, each of the second windings 2*b* is electromagnetically coupled to the first winding 1*b* connected to the post-staged discharge tube. FIG. 14 shows a configuration of another multi-discharge tube lighting apparatus in which the capacitors 20 shown in the lighting apparatus of FIG. 13 are omitted.

FIG. 15 shows another multi-discharge tube lighting apparatus. In the multi-discharge tube lighting apparatus, a first discharge tube 1*a* and a second discharge tube 2*a* of each of first to third discharge tube units 1 to 3 are respectively connected to one terminal and the other terminal of an AC power supply 10. A second winding 2*b* connected to the first discharge tube 1*a* of the first discharge tube unit 1 is electromagnetically coupled to a first winding 1*b* connected to the second discharge tube 2*a* of the first discharge tube unit 1, and this second winding 2*b* is connected to a common line 4. The first winding 1*b* connected to the second discharge tube 2*a* of the first discharge tube unit 1 is series-connected to a second winding 2*b* electromagnetically coupled to a first winding 1*b* connected to the first discharge tube 1*a* of the second discharge tube unit 2, and this second winding 2*b* is connected to the common line 4. Accordingly, FIG. 15 shows such an arrangement that a series circuit of the first winding 1*b* and the second winding 2*b* is connected between the common line 4 and the discharge tubes 1*a* and 2*a* of each of the first to third discharge tube units 1, 2, 3; each of the first windings 1*b* thereof is electromagnetically coupled to the second winding 2*b* of the pre-staged discharge tube, that is, each of the second windings 2*b* is electromagnetically coupled to the first winding 1*b* of the post-staged discharge tube. FIG. 16 shows another multi-discharge tube lighting apparatus in which the capacitors 20 shown in the lighting apparatus of FIG. 15 have been omitted. The multi-discharge tube lighting apparatus shown in FIG. 13 to FIG. 16 can average and balance the current in a similar manner to those shown in FIG. 10 and FIG. 11. The discharge tube lighting apparatuses capable of averaging and balancing the current in the above-explained manners is disclosed in, for instance, JP-A-2004-335443.

In a lighting apparatus for lighting a large number of discharge tubes, current flowing through at least one discharge tube in a single discharge tube unit can be balanced. However, in order to balance the current with respect to discharge tubes of other discharge tube units, it is necessary to provide transformers for balancing the current. As a consequence, in the above-described discharge tube lighting apparatus containing two discharge tubes in each discharge tube unit, a plurality of transformers are necessarily required, the total number of which is equal to twice number of the discharge tube units or equal to the number calculated by subtracting 1 from the twice number of the total number of the discharge tube units. As a result, costs of the discharge tube lighting apparatus may be increased.

SUMMARY

Accordingly, one aspect of the invention has an object to provide a multi discharge tube lighting apparatus with reduced number of transformers capable of balancing currents flowing through a plurality of discharge tubes.

According to a first aspect of the invention, there is provided a multi-discharge tube lighting apparatus connectable to a power source comprising a first output terminal and a second output terminal respectively outputting voltages of opposite phases, the lighting apparatus comprising: first to n-th discharge tube units where n represents an integer of two or more, each of which has a first end connected to the first output terminal and a second end connected to the second output terminal and comprises at least one discharge tube, a first winding, and a second winding, which are connected in series between a first end and a second end, wherein the first winding of the first discharge tube unit is electromagnetically coupled via a transformer to the second winding of the n-th discharge tube unit, and wherein the first windings of the second and subsequent discharge tube units are electromagnetically coupled via transformers to the second windings of the previous discharge tube units, respectively.

According to a second aspect of the invention, there is provided a multi-discharge tube lighting apparatus connectable to a power source comprising a first output terminal and a second output terminal respectively outputting voltages of opposite phases, the lighting apparatus comprising: a first discharge tube unit and a second discharge tube unit connected in parallel with respect to the power source, each of the first discharge tube unit and the second discharge tube unit comprising at least one discharge tube, a first winding and a second winding, wherein the second winding of the first discharge tube unit is electromagnetically coupled to the first winding of the second discharge tube unit.

DESCRIPTION OF THE EMBODIMENT

Figure 1:
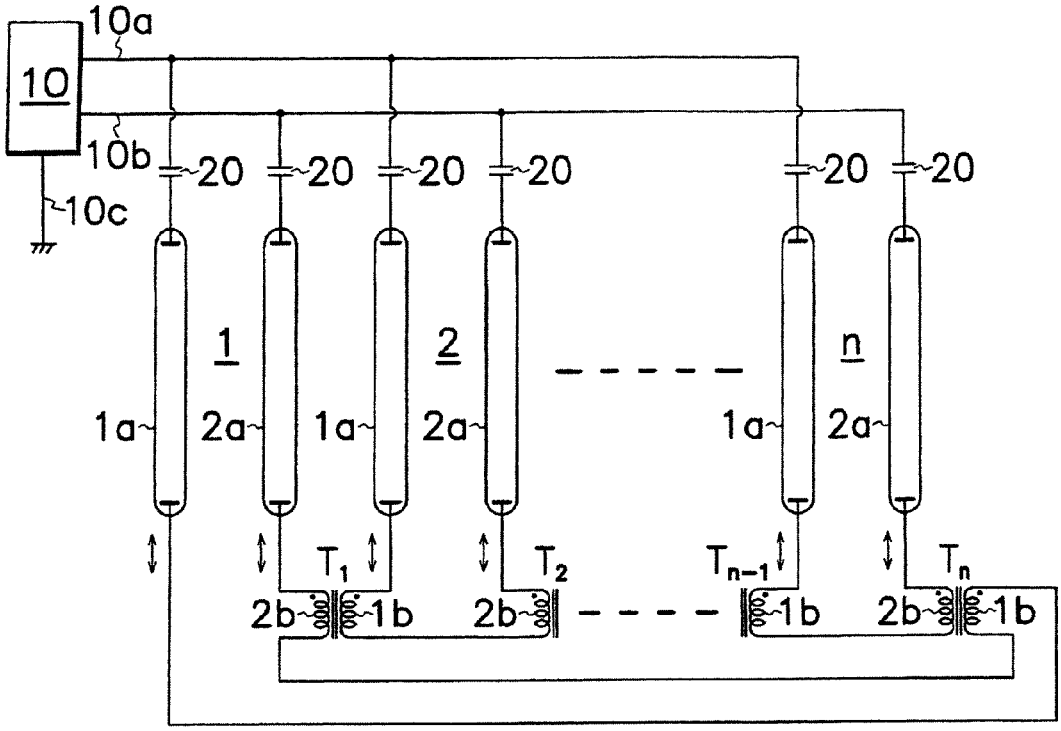
FIG. 1 is an electric circuit diagram for showing a multi-discharge tube lighting apparatus according to a first embodiment of the present invention.

A description will now be made of various embodiments of multi-discharge tube lighting apparatuses according to the present invention with reference to FIG. 1 to FIG. 9. It should be noted that the same reference numerals shown in FIG. 10 to FIG. 16 will be employed as those for denoting the similar structural elements represented in FIG. 1 to FIG. 9, and descriptions thereof will be omitted.

As shown in FIG. 1, a multi-discharge tube lighting apparatus, according to a first embodiment of the present invention, includes n sets of discharge tube units 1 to n (where "n" represents: an integer of two or more; and the total number of the discharge tube units), which is connectable to an AC power supply 10. Each of these discharge tube units 1 to n contains a first discharge tube 1*a*, a first winding 1*b*, a second winding 2*b*, and a second discharge tube 2*a*, which are connected in series. The AC power supply 10 generates alternating voltages having opposite phases to each other from a first output terminal 10*a* and a second output terminal 10*b* of the AC power supply 10, and a potential at a ground terminal 10*c* thereof is defined as a reference potential. The first output terminal 10*a* and the second output terminal 10*b* are respectively connected to one end and the other end of each of the discharge tube units 1 to n via respective capacitors 20. Each of these discharge tube units 1 to n includes series-connected first discharge tube 1*a* having a straight shape and a second discharge tube 2*a* having a straight shape so as to form a pseudo U shape. The first winding 1*b* of the first discharge tube unit 1 is electromagnetically coupled via a transformer "Tn=m" (where, "m" represents the total number of the transformers) to the second winding 2*b* of the n-th discharge tube unit n; the first winding 1*b* of the second discharge tube unit 2 is electromagnetically coupled via a transformer T1 to the second winding 2*b* of the first discharge tube unit 1; and third and succeeding discharge tube units 3 to n are arranged in a similar manner as to the second discharge tube unit. Accordingly, the respective first windings 1*b* of the second and succeeding-numbered discharge tube units are electromagnetically coupled via the transformers T2 to Tn−1 to the second windings 2*b* of the respective preceding-numbered discharge tube units.

Also, the second winding 2*b* of the second discharge tube unit 2 is electromagnetically coupled via the transformer T2 to the first winding 1*b* of the third discharge tube unit 3, and the third and succeeding-numbered discharge tube units are arranged in a similar manner. Accordingly, the respective second windings 2*b* of the second and succeeding-numbered discharge tube units are electromagnetically coupled via the transformers T2 to Tn−1 to the first windings 1*b* of the third and succeeding-numbered discharge units respectively. It should be noted that the transformers T1 to Tn are tightly coupled transformers whose turn ratios are 1:1. As described above, in the first embodiment of the present invention, the first windings 1*b* and the second windings 2*b* as to the adjacent discharge tube units and the first and n-th discharge tube units are electromagnetically coupled via the transformers T1 to Tn to each other. As a result, a total number of the transformers is reduced, as compared with those of the multi-discharge tube lighting apparatus described in the background art, the multi-discharge tube lighting apparatus of the first embodiment can be made compact, and the manufacturing cost thereof can be reduced. Also, since the transformers averaging the current flowing through the respective discharge tube units 1 to n are connected, when the multi-discharge tube lighting apparatus is activated, electromotive force is produced in a transformer connected to a discharge tube which has not yet been turned ON, and therefore, a voltage to be applied to the discharge tube which has not yet been turned ON is increased, so that this discharge tube can be readily turned ON. Also, since the total number of the transformers is reduced, as compared with that of the multi-discharge tube lighting apparatus described in the background art, the multi-discharge tube lighting apparatus of the first embodiment can be made compact so as to be assembled to various sorts of electronic appliances, and furthermore, can be manufactured in lower cost.

Figure 2:
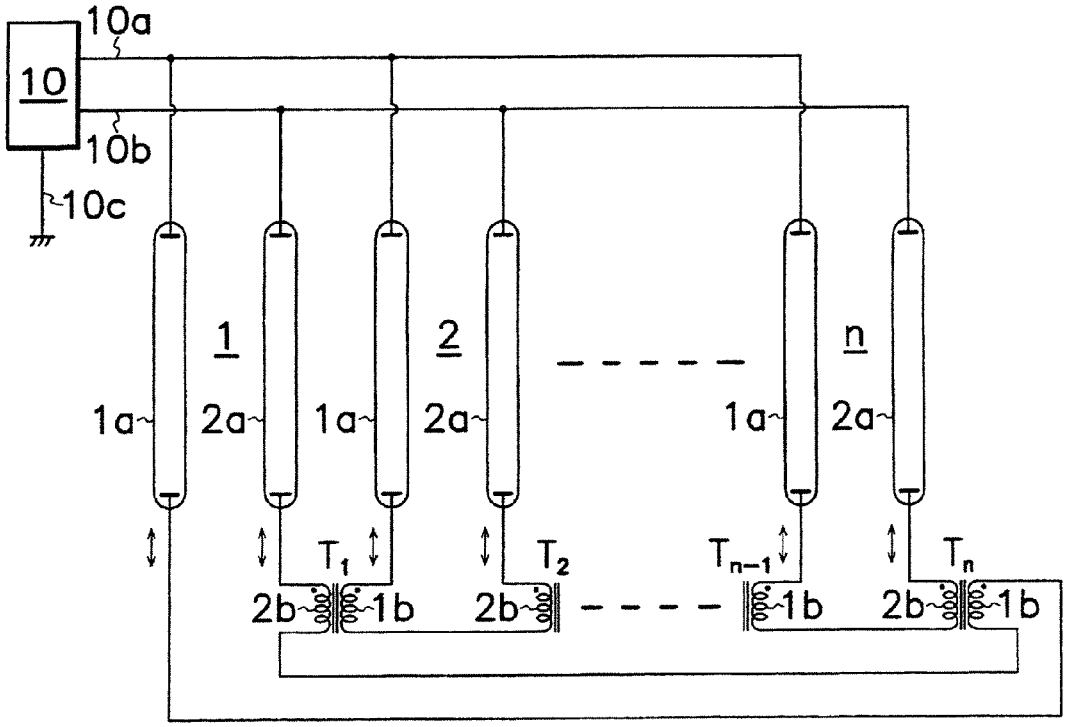
FIG. 2 is an electric circuit diagram for representing a multi-discharge tube lighting apparatus according to a second embodiment of the present invention, in which capacitors are omitted from the first embodiment of FIG. 1.
Figure 3:
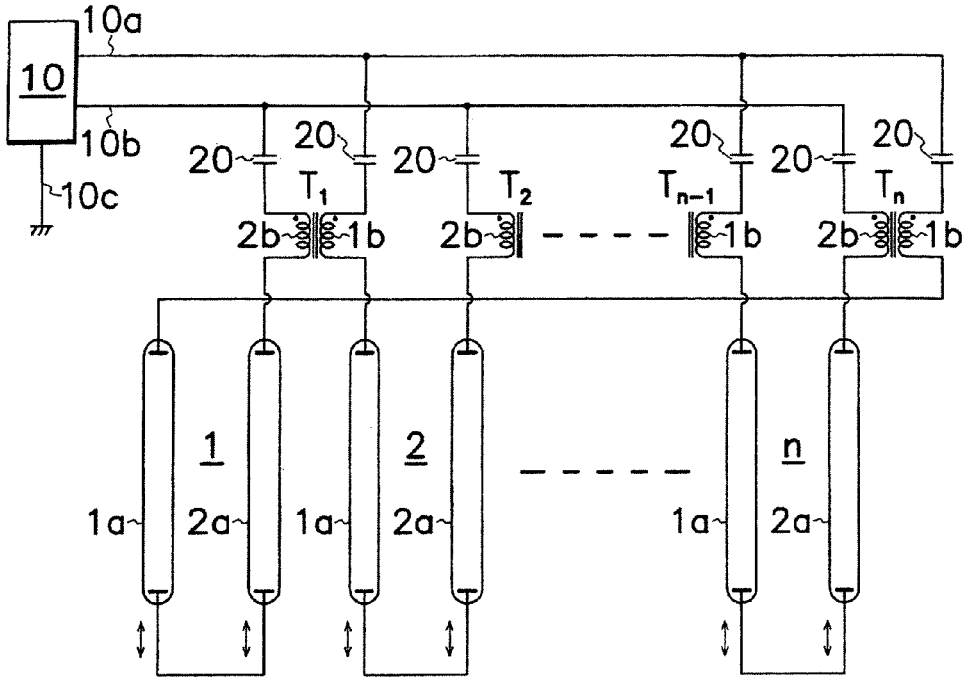
FIG. 3 is an electric circuit diagram for showing a multi-discharge tube lighting apparatus according to a third embodiment of the present invention, in which the connecting sequence of the circuit elements provided in the discharge tubes unit is changed.
Figure 4:
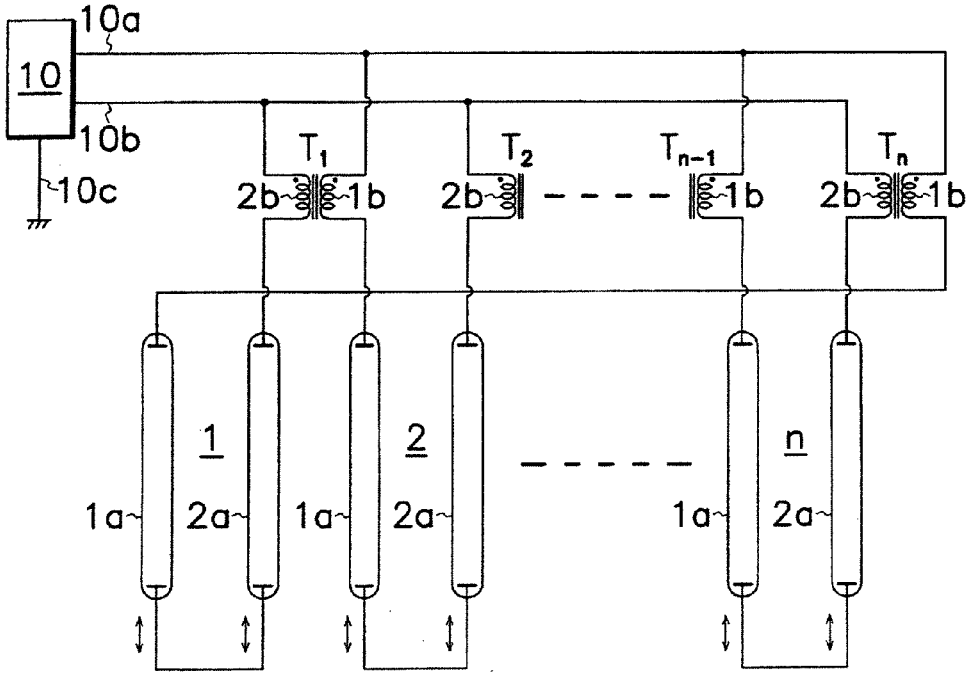
FIG. 4 is an electric circuit diagram for representing a multi-discharge tube lighting apparatus according to a fourth embodiment of the present invention, in which capacitors are omitted from the third embodiment of FIG. 3.
Figure 5:
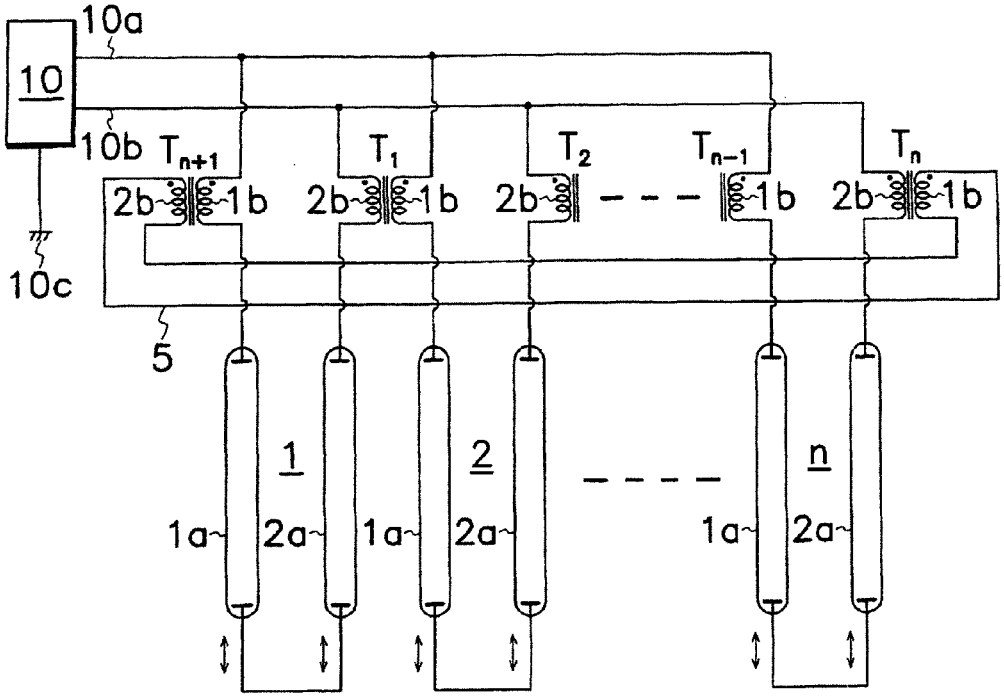
FIG. 5 is an electric circuit diagram for showing a multi-discharge tube lighting apparatus according to a fifth embodiment of the present invention, in which the arrangements of the transformers are changed.

The multi-discharge tube lighting apparatus shown in FIG. 1 according to the first embodiment of the present invention may be modified in various manners. For instance, as shown in FIG. 2, the capacitors 20 (shown in FIG. 1) connected between the respective discharge tubes 1*a*, 2*a*, and the AC power supply 10 may be omitted. Also, in FIG. 1, each set of the discharge tube units 1 to n is arranged in such a sequential manner that the first discharge tube 1*a*, the first winding 1*b*, the second winding 2*b*, and the second discharge tube 2*a* are connected via the capacitor 20 to the AC power supply 10. Alternatively, this connecting sequence may be properly changed. For example, as shown in FIG. 3, each set of the discharge tube units 1 to n may be arranged in such a sequential manner that the first winding 1*b*, the first discharge tube 1*a*, the second discharge tube 2*a*, and the second winding 2*b* are connected via the capacitor 20 to the AC power supply 10. In the above-described case, as shown in FIG. 4, the capacitors 20 may be omitted. Also, as shown in FIG. 5, the multi-discharge tube lighting apparatus may further include a transformer Tm=n+1 including a first winding 1*b* and a second winding 2*b*. The second winding 2*b* of the transformer Tn+1 forms a pair with a first winding 1*b* of a first discharge tube unit 1. The first winding 1*b* of the transformer Tn+1 forms a pair with a second winding 2*b* connected to a second discharge tube 2*a* of an n-th discharge tube unit n. The first and second windings 1*b*, 2*b* of the transformer Tn+1 are connected by a connection line 5. Accordingly, the first winding 1*b* of the first discharge tube unit 1 is electromagnetically coupled to the second winding 2*b* of the n-th discharge tube unit n via the transformers Tn, Tn+1.

The turn ratio of the first winding 1*b* to the second winding 2*b* as to the transformer Tn and the transformer Tn+1 may be changed from 1:1, depending upon use condition. For instance, a turn ratio of the first winding 1*b* to the second winding 2*b* as to the transformer Tn may be selected to be 0.1:1, whereas a turn ratio of the first winding 1*b* to the second winding 2*b* as to the transformer Tn+1 may be selected to be 1:0.1, namely, turn ratios of such transformers which are connected to each other may be changed in the same ratio. When a turn ratio is decreased, a voltage produced on the connection line 5 is lowered, so that an adverse influence caused from the connection line 5 to an external unit may be reduced, or an adverse influence given from the external unit to a winding may be reduced. When a winding ratio is increased, a voltage produced on the connection line 5 is increased, since a current is decreased, an adverse influence caused by electromagnetic indications may be reduced.

Figure 6:
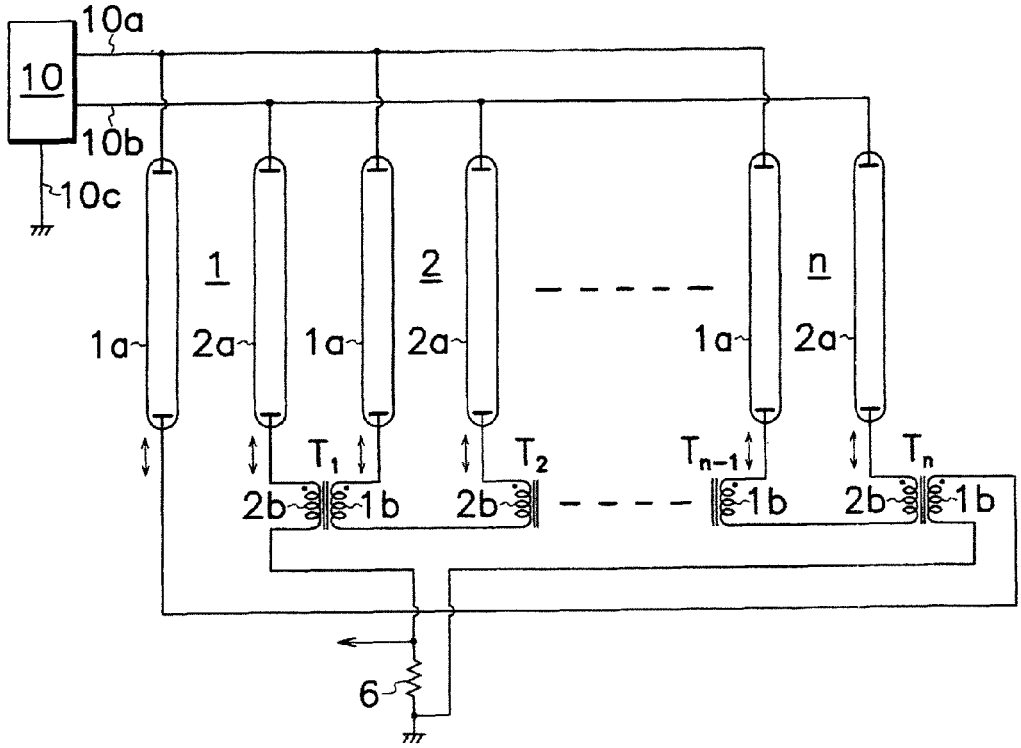
FIG. 6 is an electric circuit diagram for showing a multi-discharge tube lighting apparatus according to a sixth embodiment of the present invention, in which a current detecting resistor is provided.
Figure 7:
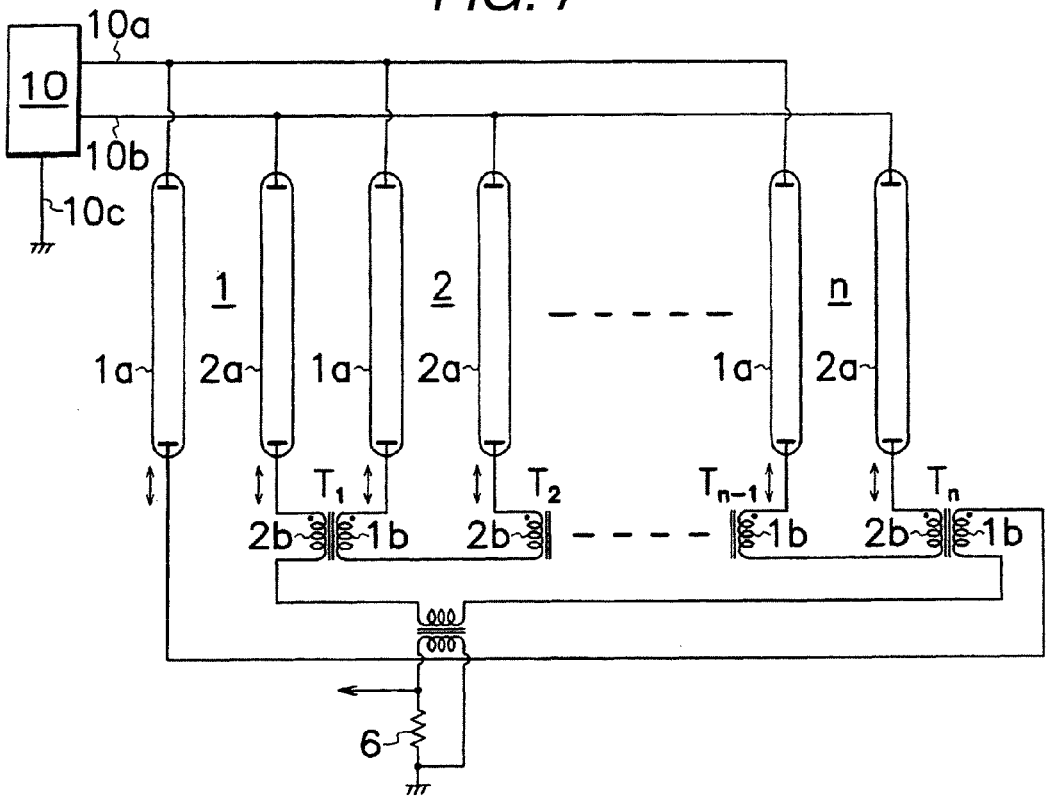
FIG. 7 is an electric circuit diagram for showing a multi-discharge tube lighting apparatus according to a seventh embodiment of the present invention, in which current detecting means made by a current transformer is provided.
Figure 8:
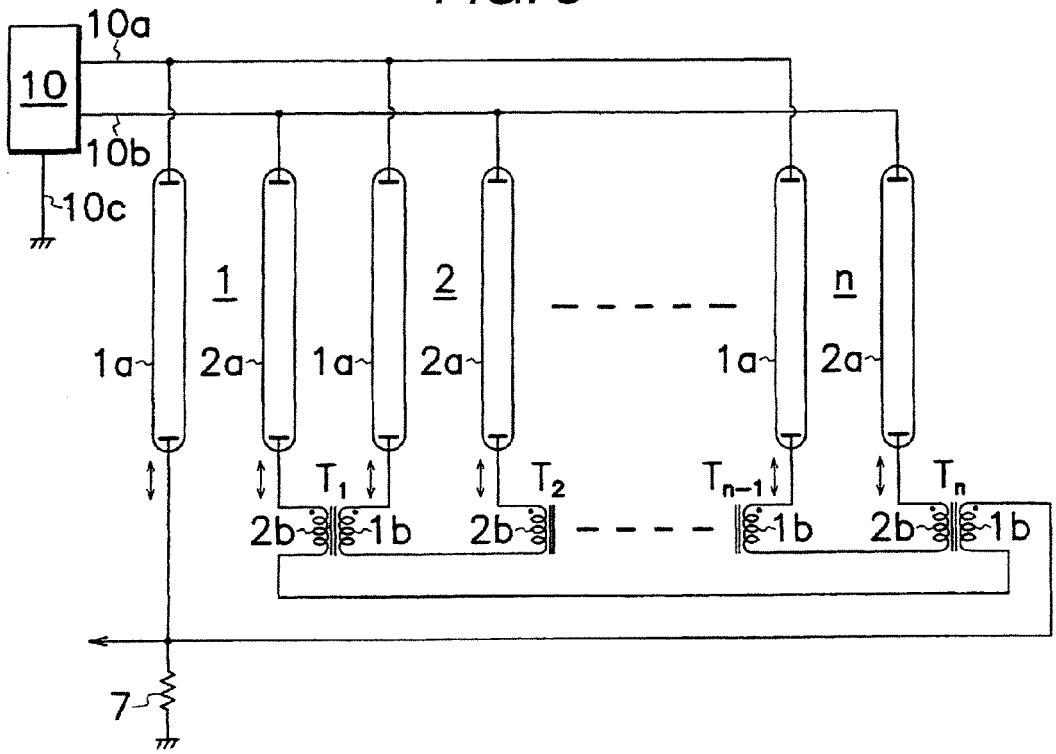
FIG. 8 is an electric circuit diagram for showing a multi-discharge tube lighting apparatus according to an eighth embodiment of the present invention, in which a voltage detecting resistor is provided.
Figure 9:
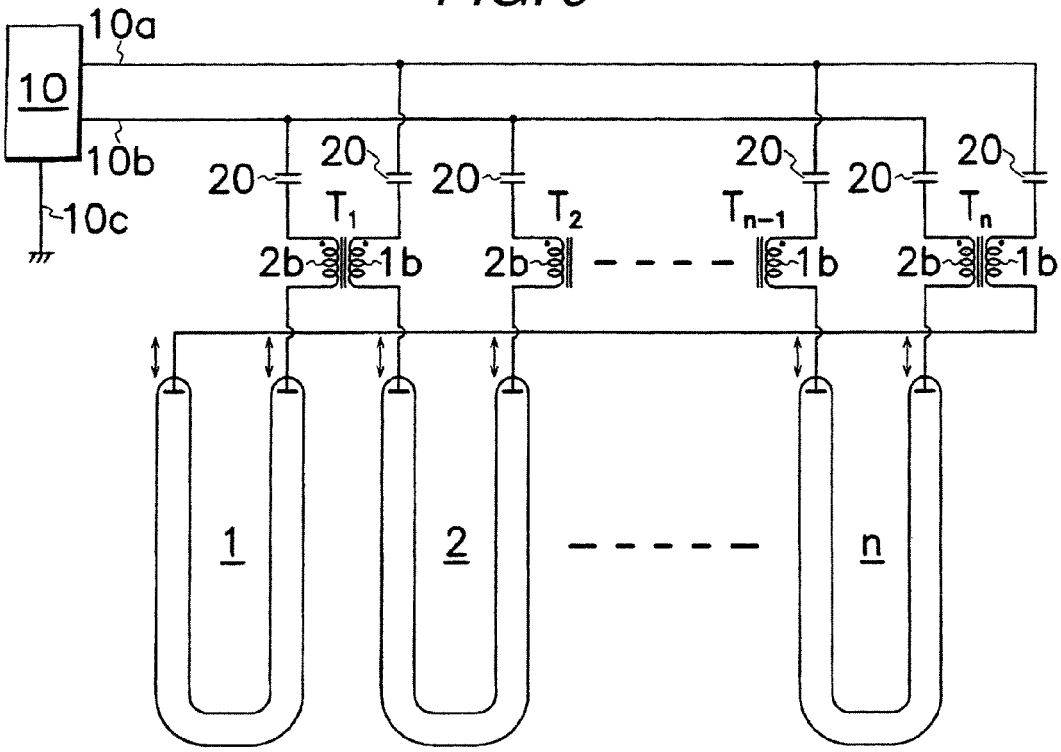
FIG. 9 is an electric circuit diagram for representing a multi-discharge tube lighting apparatus according to a ninth embodiment of the present invention, which employs a U-shaped discharge tube.
Figure 10:
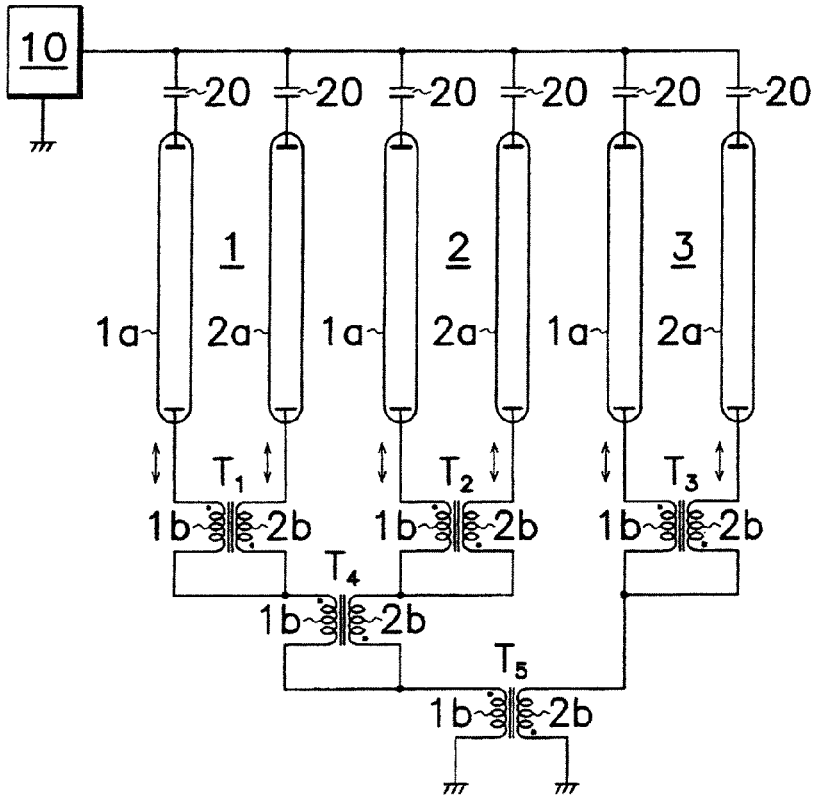
FIG. 10 is the circuit diagram for showing the first conventional example of the multi-discharge tube lighting apparatus.
Figure 11:
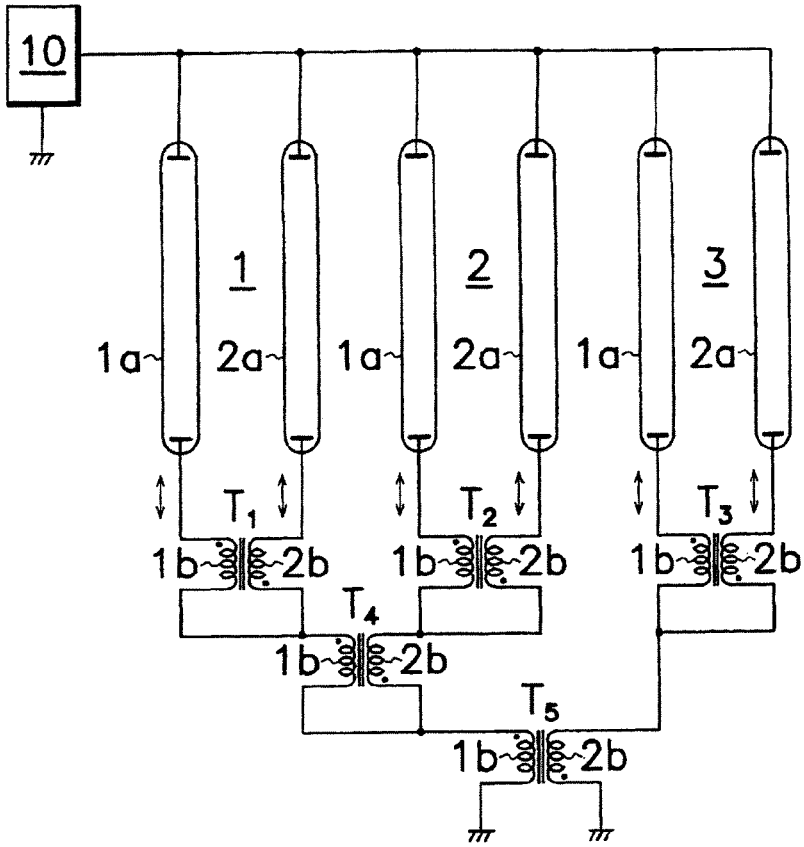
FIG. 11 is the circuit diagram for indicating the second conventional example which is manufactured by omitting the capacitors from the circuit of FIG. 10.
Figure 12:
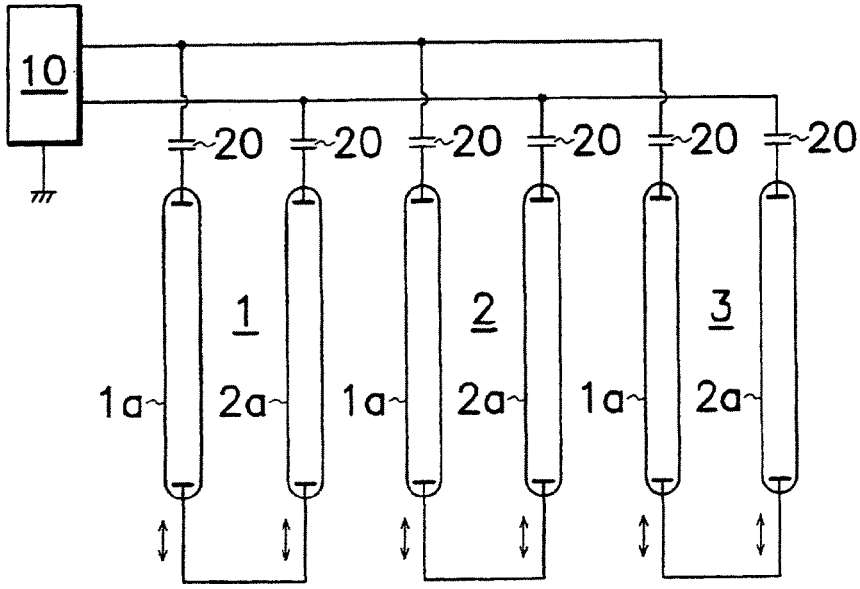
FIG. 12 is the circuit diagram for showing the third conventional example of the multi-discharge tube lighting apparatus.
Figure 13:
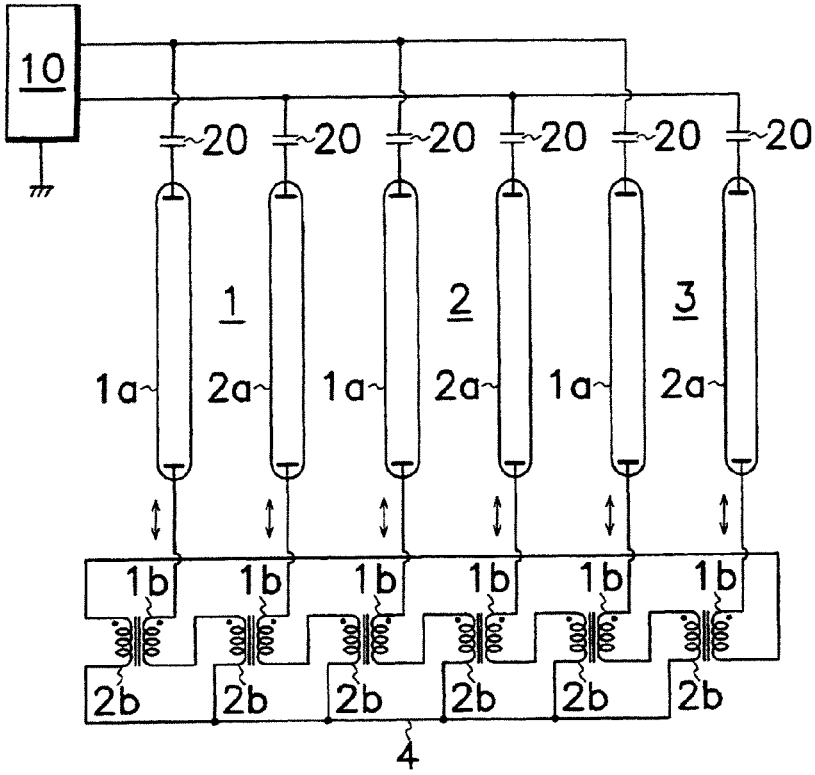
FIG. 13 is the circuit diagram for indicating the fourth conventional example which is manufactured by changing the connecting structure of the transformers.
Figure 14:
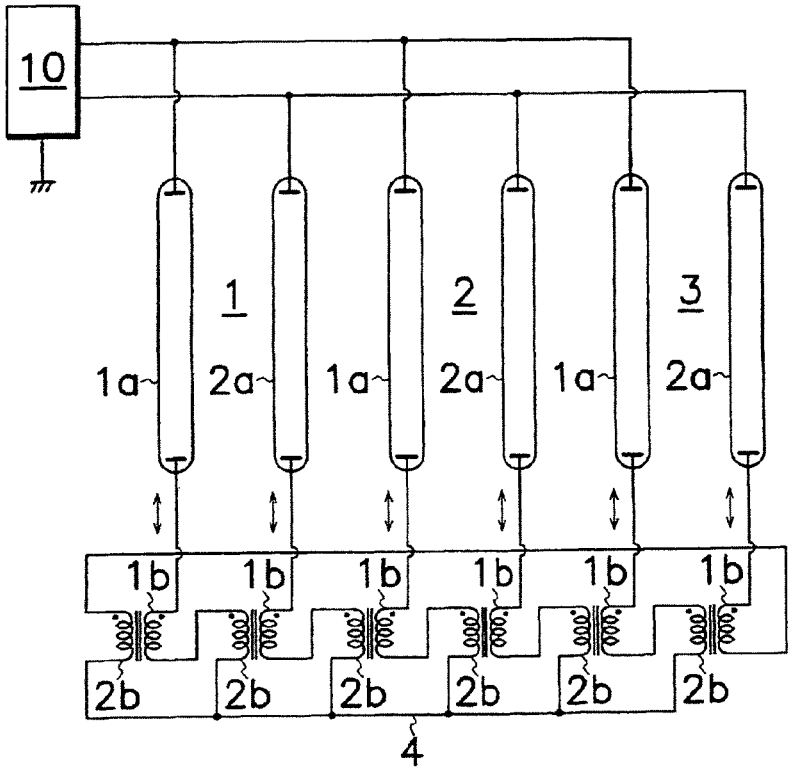
FIG. 14 is the circuit diagram for indicating the fifth conventional example which is manufactured by omitting the capacitors from the circuit of FIG. 13.
Figure 15:
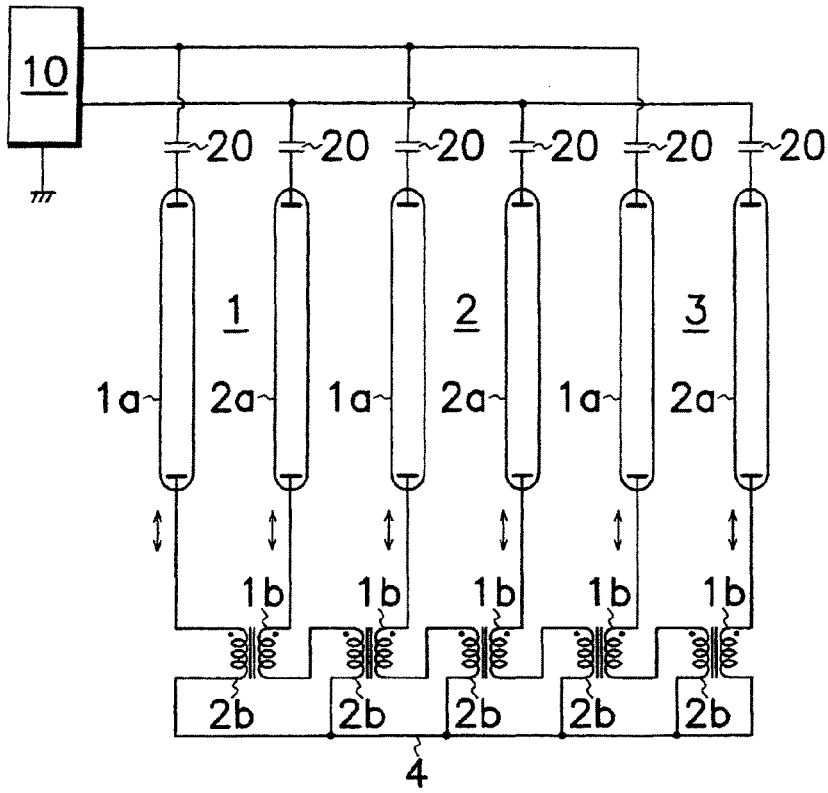
FIG. 15 is the circuit diagram for indicating the sixth conventional example which is manufactured by reducing a total number of the transformers from the circuit of FIG. 13.
Figure 16:
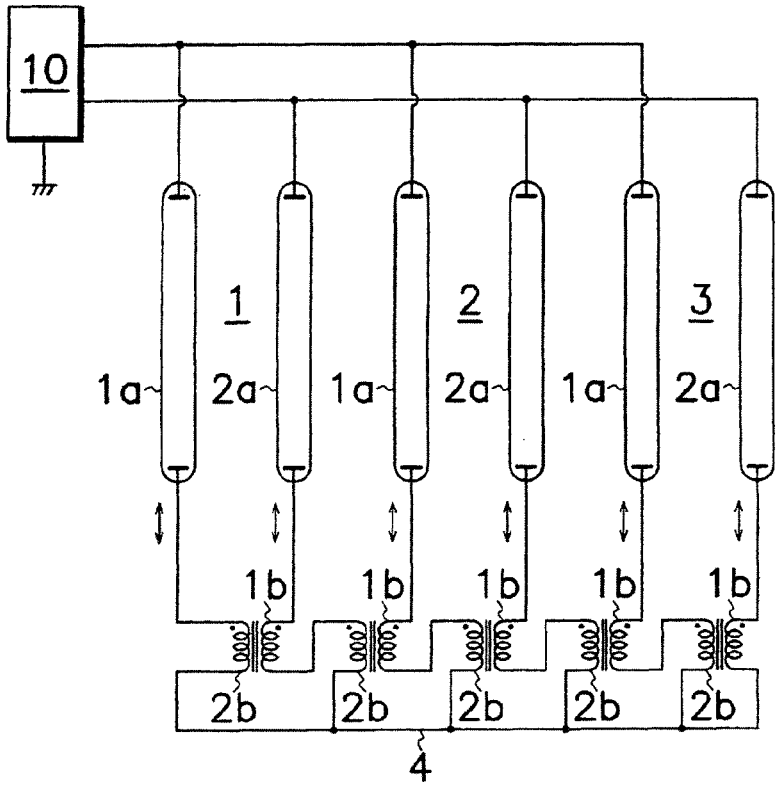
FIG. 16 is the circuit diagram for indicating the seventh conventional example which is manufactured by omitting the capacitors from the circuit of FIG. 15.

Alternatively, as shown in FIG. 6, a current detecting resistor 6 serving as an example of a current detecting unit may be provided in at lease one of the first to n-th discharge tube units 1 to n. In the illustrated example, the current detecting resistor 6 is series-connected to the first winding 1*b* and the second winding 2*b* of the first discharge tube unit 1. One end of the current detecting resistor 6 is connected to the ground, so that a value of a current flowing through the first discharge tube 1*a* and the second discharge tube 2*a* of the first discharge tube unit 1 is detected by this current detecting resistor 6. As a result, values of currents flowing through all of discharging tubes 1*a* and 2*a* can be detected, which enables various sorts of controls (for instance, current value controls) to be performed with respect to the multi-discharge tube lighting apparatus based on the detected current values. FIG. 7 represents an example in which the current detecting resistor 6 is connected to the first discharge tube unit 1 via a current detecting transformer provided between the first winding 1*b* and the second winding 2*b* of the first discharge tube unit 1. Also, as shown in FIG. 8, a voltage detecting resistor 7 serving as an example of a voltage detecting unit may be connected to any terminal of a first winding 1*b* and a second winding 2*b* of any one of n sets of the above-explained discharge tube units, so that a value of a voltage applied to the first discharge tube 1*a* and the second discharge tube 2*a* may be detected by this voltage detecting resistor 7. For instance, the voltage detecting resistor 7 is connected between the ground and a junction point between the first winding 1*b* and the first discharge tube 1*a* of the first discharge tube unit 1, so that various sorts of controls (for example, voltage value control) can be performed with respect to the multi-discharge tube lighting apparatus in response to a detected voltage value, and a failure of a discharge tube and dismounting of a discharge tube can be detected by the above-described voltage detecting unit. Also, the above-described current detections and voltage detections can be performed by low cost and easy structures. Furthermore, as shown in FIG. 9, each of discharge tube units 1 to n may include a U-shaped discharge tube.

The embodiments of the present invention can be especially advantageously embodied in such a multi-discharge tube lighting apparatus which includes a plurality of discharge tube units having at least a pseudo single U-shaped discharge tube among plural discharge tubes, and in which currents flowing through the respective discharge tubes are balanced by transformers.

Since the total number of the transformers is reduced, the multi-discharge tube lighting apparatus can be made compact and manufactured in low cost, and the reduced-sized multi-discharge tube lighting apparatus can be assembled in various electronic devices.

What is claimed is:

1. A multi-discharge tube lighting apparatus connectable to a power source comprising a first output terminal and a second output terminal respectively outputting voltages of opposite phases, the lighting apparatus comprising:

first to n-th discharge tube units where n represents an integer of two or more, each of which has a first end connected to the first output terminal and a second end connected to the second output terminal and comprises at least one discharge tube, a first winding, and a second winding, which are connected in series between the first end and the second end, wherein the first winding of the first discharge tube unit is electromagnetically coupled via a transformer to the second winding of the n-th discharge tube unit, and wherein the first windings of the second and subsequent discharge tube units are electromagnetically coupled via transformers to the second windings of the previous discharge tube units, respectively.

2. The multi-discharge tube lighting apparatus according to claim 1, wherein each of the transformers is a tightly coupled transformer having a turn ratio of 1:1.

3. The multi-discharge tube lighting apparatus according to claim 1, further comprising a plurality of capacitors connected between the first output terminal of the power source and each of the first ends of the discharge tube units and between the second output terminal of the power source and each of the second ends of the discharge tube units.

4. The multi-discharge tube lighting apparatus according to claim 1, further comprising: a current detecting unit series-connected to the first winding and the second winding of one of the discharge tube units, the current detecting unit configured to detect a current flowing through the one of the discharge tube units.

5. The multi-discharge tube lighting apparatus according to claim 1, further comprising at least one voltage detecting unit connected to a terminal of one of the first winding and the second winding of respective discharge tube unit, the voltage detecting unit configured to detect an abnormal status of the discharge tube of the respective discharge tube units.

6. The multi-discharge tube lighting apparatus according to claim 1, further comprising a connection winding provided in the n-th transformer that electromagnetically couples the first winding of the first discharge tube unit to the second winding of the n-th discharge tube unit.

7. The multi-discharge tube lighting apparatus according to claim 1, wherein each of the discharge tube units comprises: a straight-shaped first discharge tube; and a straight-shaped second discharge tube that is series-connected to the straight-shaped first discharge tube and is disposed substantially along the straight-shaped first discharge tube.

8. The multi-discharge tube lighting apparatus according to claim 1, wherein each of the discharge tube units has a pseudo U-shaped form.

9. The multi-discharge tube lighting apparatus according to claim 1, wherein the elements in each of the discharge tube units is connected in any one of the following sequences:

(1) a first discharge tube, the first winding, the second winding, and a second discharge tube; and (2) the first winding, a first discharge tube, a second discharge tube, and the second winding.

10. The multi-discharge tube lighting apparatus according to claim 1, further comprising at least one voltage detecting unit connected to a terminal of one of the first winding and the second winding of one of the first to n-th discharge tube units, the voltage detecting unit configured to detect an abnormal status of the at least one discharge tube of the one of the first to n-th discharge tube units.

11. The multi-discharge tube lighting apparatus according to claim 1, wherein at least one of the discharge tube units comprises a first discharge tube and a second discharge tube.

12. The multi-discharge tube lighting apparatus according to claim 11, wherein the first discharge tube, the first winding, the second winding, and the second discharge tube of the at least one of the discharge tube units are connected in the following sequence: the first discharge tube, the first winding, the second winding, and the second discharge tube.

13. The multi-discharge tube lighting apparatus according to claim 11, wherein the first discharge tube, the first winding, the second winding, and the second discharge tube of the at least one of the discharge tube units are connected in the following sequence: the first winding, the first discharge tube, the second discharge tube, and the second winding.

14. The multi-discharge tube lighting apparatus according to claim 1, wherein each of the discharge tube units comprises a first discharge tube and a second discharge tube.

15. The multi-discharge tube lighting apparatus according to claim 14, wherein the first discharge tube, the first winding, the second winding, and the second discharge tube in each of the discharge tube units are connected in the following sequence: the first discharge tube, the first winding, the second winding, and the second discharge tube.

16. The multi-discharge tube lighting apparatus according to claim 14, wherein the first discharge tube, the first winding, the second winding, and the second discharge tube in each of the discharge tube units are connected in the following sequence: the first winding, the first discharge tube, the second discharge tube, and the second winding.

* * * * *